US006282989B1

(12) United States Patent
Sorter

(10) Patent No.: US 6,282,989 B1
(45) Date of Patent: Sep. 4, 2001

(54) POWER VALVE WRENCH

(76) Inventor: James L. Sorter, 9760 Lime Lake Rd., Hudson, MI (US) 49247

( * ) Notice: Subject to any disclaimer, the term of this patent is extended or adjusted under 35 U.S.C. 154(b) by 0 days.

(21) Appl. No.: 09/514,776

(22) Filed: Feb. 28, 2000

(51) Int. Cl.[7] ..... B25B 21/00

(52) U.S. Cl. ..... 81/57.13; 81/57.29; 81/57.46; 81/176.15; 81/124.2

(58) Field of Search ..... 81/57.13, 57.29, 81/57.46, 176.15, 124.2

(56) References Cited

U.S. PATENT DOCUMENTS

| | | | | |
|---|---|---|---|---|
| 2,004,639 | | 6/1935 | Thewes . | |
| 3,010,346 | | 11/1961 | Kulp . | |
| 3,838,614 | * | 10/1974 | O'Donnell | 81/177.2 X |
| 4,179,955 | | 12/1979 | Akiyoshi et al. . | |
| 4,325,274 | * | 4/1982 | Martelee | 81/57.13 |
| 4,524,649 | | 6/1985 | Diaz et al. . | |
| 4,635,732 | | 1/1987 | Gotsch et al. . | |
| 4,729,269 | | 3/1988 | Killian . | |
| 4,817,475 | | 4/1989 | Kelly et al. . | |
| 5,090,273 | | 2/1992 | Fossella . | |
| 5,203,240 | | 4/1993 | Sorter . | |
| 5,277,087 | * | 1/1994 | Wilson et al. | 81/57.46 X |
| 5,279,192 | | 1/1994 | Hartman | 82/113 |
| 5,425,290 | * | 6/1995 | Fought et al. | 81/124.2 X |

* cited by examiner

*Primary Examiner*—James G. Smith
(74) *Attorney, Agent, or Firm*—Brinks Hofer Gilson Lione

(57) ABSTRACT

A power valve wrench includes a power drive assembly having a motor and a speed reduction device driving an annulus which defines a large center opening and a plurality of lugs or recesses on the interior wall of the annulus. The opening in the annulus receives a drive member having complementary lugs or recesses. The drive member, in turn defines a concentric polygonal opening which may be square, hexagonal, octagonal or other regular polygon shape which receives a complementarily configured stanchion of a valve handwheel drive member. A selection of valve handwheel drive members having 4, 6, 8, 10 or 12 slots may be utilized with the power valve wrench. A safety or retaining ring removably attached to the valve handwheel drive member retains the member on a valve handwheel.

22 Claims, 4 Drawing Sheets

POWER VALVE WRENCH

BACKGROUND OF THE INVENTION

The invention relates generally to wrenches for opening and closing valves operable by hand wheels and more particularly to a power valve wrench having a motor which drives a hand wheel engaging member through a speed reduction device.

In refineries, petrochemical plants, steam or nuclear power generating plants, water treatment plants and other facilities where large liquid and gas flows are common, significant numbers of large valves are equally common. Typically, such valves are operated by hand wheels having diameters of from several inches to a few feet. Although hand wheel size is related generally to the size of the valve and the torque necessary to open and close it, the actual torque necessary to open and close a valve, either as it ages or is only occasionally operated, can increase dramatically from the initial operating torque. In many instances, the operating torque of an aging or seldom used valve may be great enough to present the potential for human injury or it may simply render it inoperable.

This problem has been addressed in the prior art. For example, U.S. Pat. No. 1,460,922 discloses a valve actuating means compromising a radially extending handle which is disposed about the valve stem and includes projections which engage the valve hand wheel or its spokes.

A similar construction is illustrated in U.S. Pat. No. 2,920,517 wherein an elongate handle is received on the stem of the valve and a pair of spaced apart projections straddle a valve spoke and engage the hand wheel.

U.S. Pat. Nos. 2,086,722 and 2,539,262 disclose valve turning tools which both engage only the outer wheel portion of the hand wheel at two spaced apart locations.

U.S. Pat. Nos. 2,682,189 and 4,715,252 both disclose wrench like valve tools which engage the handwheel at one location. While these tools as well as several of the foregoing facilitate the application of increased torque to the valve handwheel, they have in common a significant disadvantage. Because they apply unbalanced force to the handwheel at a single location, a static bending moment is created. Such unbalanced force application is less efficient than balanced, i.e., on center, torque application and can also damage the valve.

Study of the foregoing patented devices reveals another difficulty. Many of these devices may slip upon the valve handwheel when torque is applied. Clearly an abrupt, spontaneous repositioning of the device on the handwheel is undesirable. Furthermore, many of these designs are not self retaining and will disconnect and fall from the valve handwheel if not held in position by an operator. Finally, many of the foregoing devices are suitable for only a specific size or limited range of sizes of valve handwheels.

My prior U.S. Pat. No. 5,203,240 addresses many of these problems. Here, a circular drive member having a plurality of T-shaped slots engages the spokes of a valve handwheel and is rotated by a ratchet drive mechanism having a handle. While this device addresses many of the problems of the prior art, the opening and closing of a large valve which may require several turns and significant torque application through a ratchet mechanism can be tedious and time consuming.

The foregoing suggests that improvements to devices for applying torque to valve handwheels are both desirable and possible.

SUMMARY OF THE INVENTION

A power valve wrench includes a power drive assembly having a motor and a speed reduction device driving an annulus which defines a large center opening and a plurality of lugs or recesses on the interior wall of the annulus. The opening in the annulus receives a drive member having complementary lugs or recesses. The drive member, in turn defines a concentric polygonal opening which may be square, hexagonal, octagonal or other regular polygon shape which receives a complementarily configured stanchion of a valve handwheel drive member. A selection of valve handwheel drive members having 4, 6, 8, 10 or 12 slots may be utilized with the power valve wrench. A safety or retaining ring removably attached to the valve handwheel drive member retains the member on a valve handwheel.

Accordingly, it is an object of the present invention to provide a power apparatus for applying torque to valve handwheels.

It is a further object of the present invention to provide a power apparatus for applying torque to handwheels which quickly opens or closes a valve.

It is a still further object of the present invention to provide a power apparatus for providing torque to valve handwheels having a plurality of castellated drive members with various arrangements of T-shaped slots.

It is a still further object of the present invention to provide a power apparatus for bi-directionally applying torque to valve handwheels.

It is a still further object of the present invention to provide a power apparatus for bi-directionally applying torque to valve hand wheels having a safety ring for retaining the apparatus on a valve hand wheel.

Further objects and advantages of the present invention will become apparent by reference to the following description and appended drawings wherein like referenced numbers refer to the same component, element or feature.

DESCRIPTION OF THE PREFERRED EMBODIMENT

Figure 1:
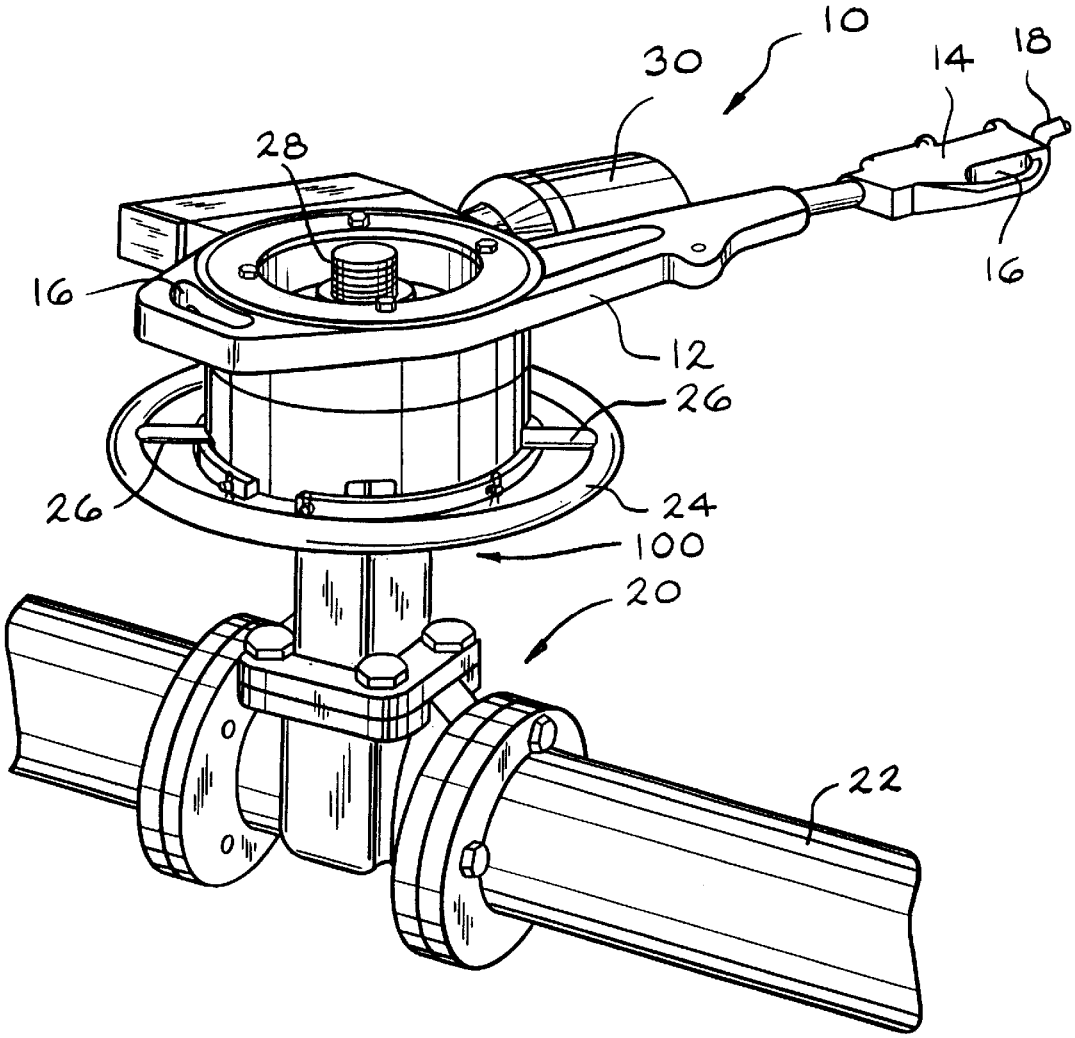
FIG. 1 is perspective view of a power valve wrench assembly according to the present invention disposed on a handheel of a valve.

Referring now to FIG. 1, a power valve wrench assembly according to the present invention is illustrated and generally designated by the reference number 10. The power valve wrench assembly 10 includes a generally elongate frame 12 having a handle 14. Both the frame 12 and the handle 14 may include hand grips 16 which may be engaged by the hands of an operator to steady the power valve wrench assembly 10 during use. The hand grip 16 in the handle 14 protects a single or multiple switches (not illustrated) which control the activation and direction of activation of the power valve wrench assembly 10. An electrical power cord 18 having a suitable plug (not illustrated) is connected to a source of electrical energy when the power valve wrench assembly 10 is in use.

Use of the power valve wrench assembly 10 is typically with a large, manually operable fluid control valve 20. The fluid control valve 20 is disposed in a pipe 22 and includes a rotatable handwheel 24 having a plurality of radially extending spokes 26. There may be three, four, six, eight or ten spokes 26 and, as noted, they may be radially oriented, obliquely Referring now to FIGS. 1, 2 and 3, the power valve wrench assembly 10 also includes a bi-directional electric drive motor 30 having an output shaft 32 which bi-directionally drives a worm gear 34. The worm gear 34 is received within a rectangular housing 36 secured to or integrally formed with a portion of the elongate frame 12 adjacent the electric drive motor 30.

The frame 12 defines a large circular opening 40 which receives a circular drive hub or collar 42 having teeth 44 disposed about its periphery which engage and are driven by the worm gear 34. Rotation of the output shaft 32 of the electric motor 30 and the worm gear 34 thus rotate the circular drive collar 42 about its axis at a rotational speed greatly reduced from the speed of the electric drive motor 30.

The circular drive collar 42, in turn, defines a circular opening 48 and includes a plurality, preferably at least four, equally circumferentially spaced-apart notches or recesses 50. The notches or recesses 50 all open in one direction and receive complementarily configured radial lugs or projections 52 formed on the periphery of an intermediate drive collar 54.

It will be appreciated that the notches or recesses 50 may be interchanged with the lugs or projections 52 such that the notches or recesses 50 are disposed on the intermediate drive collar 54 and the lugs or projection 52 are disposed on the circular drive collar 42. Alternatively, analogous or similarly functioning coupling structures such as radially extending pins, male and female splines or gear teeth or bayonet type latches, for example, may be utilized to couple the intermediate drive collar 54 to the circular drive collar 42.

The drive collar 54 is cylindrical and defines an outside diameter just slightly less than the inside diameter of the circular opening 48. One end of the intermediate drive collar 54 is open and the other end is partially closed by an integrally formed end plate 56 which defines a polygonal opening 58. Preferably, the polygonal opening 58 is hexagonal although other regular polygonal shapes such as eight-sided, ten-sided and twelve-sided may be readily utilized. If, in fact, it is desired to limit use of this device to specific, not readily available components or to limit its use to only authorized personnel, five-sided or seven-sided, for example, polygonal openings or openings having other numbers of sides or irregular shapes may also be utilized.

The intermediate drive collar 54 is positioned within the circular opening 48 of the circular drive collar 42 such that the plurality of lugs or projections 52 align with and are received within the plurality of recesses 50. So disposed, the circular drive collar 42 transmits bi-directional rotational energy to the intermediate drive collar 54 and rotates it upon rotation of the output shaft 32 of the electric drive motor 30 as will be readily appreciated.

The intermediate drive collar 54 is retained within the circular opening 48 of the drive collar 40 by a flat retaining annular plate or ring 62. A plurality of threaded fasteners 64 are utilized to secure the retaining ring 62. The plurality of threaded fasteners 64 extend through openings 66 in the retaining ring 62 and into a like plurality of threaded blind openings 68 in the intermediate drive collar 54. The retaining ring 62 thus retains the intermediate drive collar 54 within the center opening 48 of the circular drive collar 42 in a first axial direction. Interengagement of the lugs or projections 52 with the recesses 50 inhibits axial motion of the intermediate drive collar 54 through the center opening 48 of the circular drive collar 42 in the other axial direction. Thus it will be appreciated that the intermediate drive collar 54 is retained within the center opening 48 of the circular drive collar 42 and generally within the frame 12 of the power valve wrench assembly 10.

Figure 3:
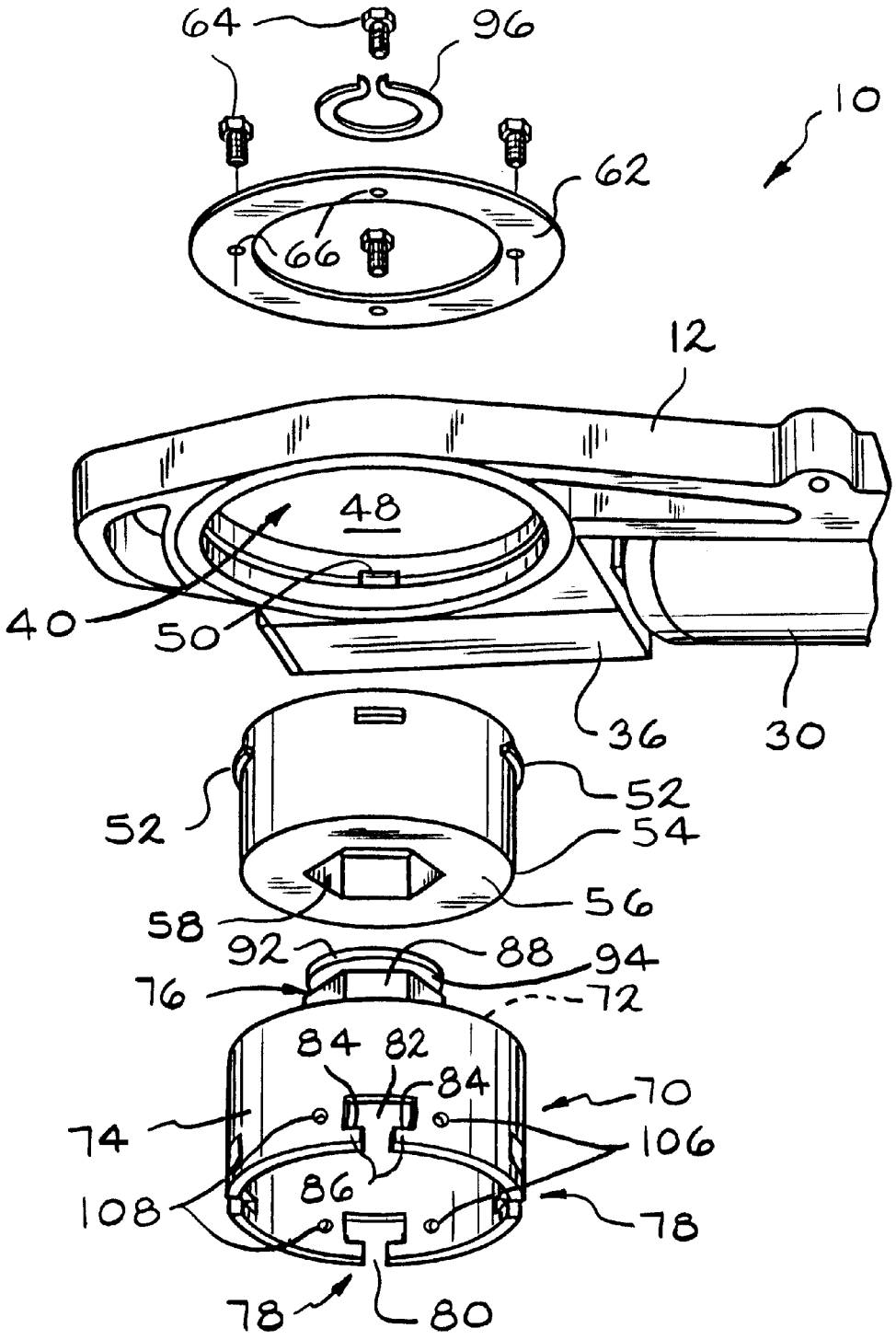
FIG. 3 is an exploded, perspective view from below of a portion of a power valve wrench assembly according to the present invention.
Figure 4:
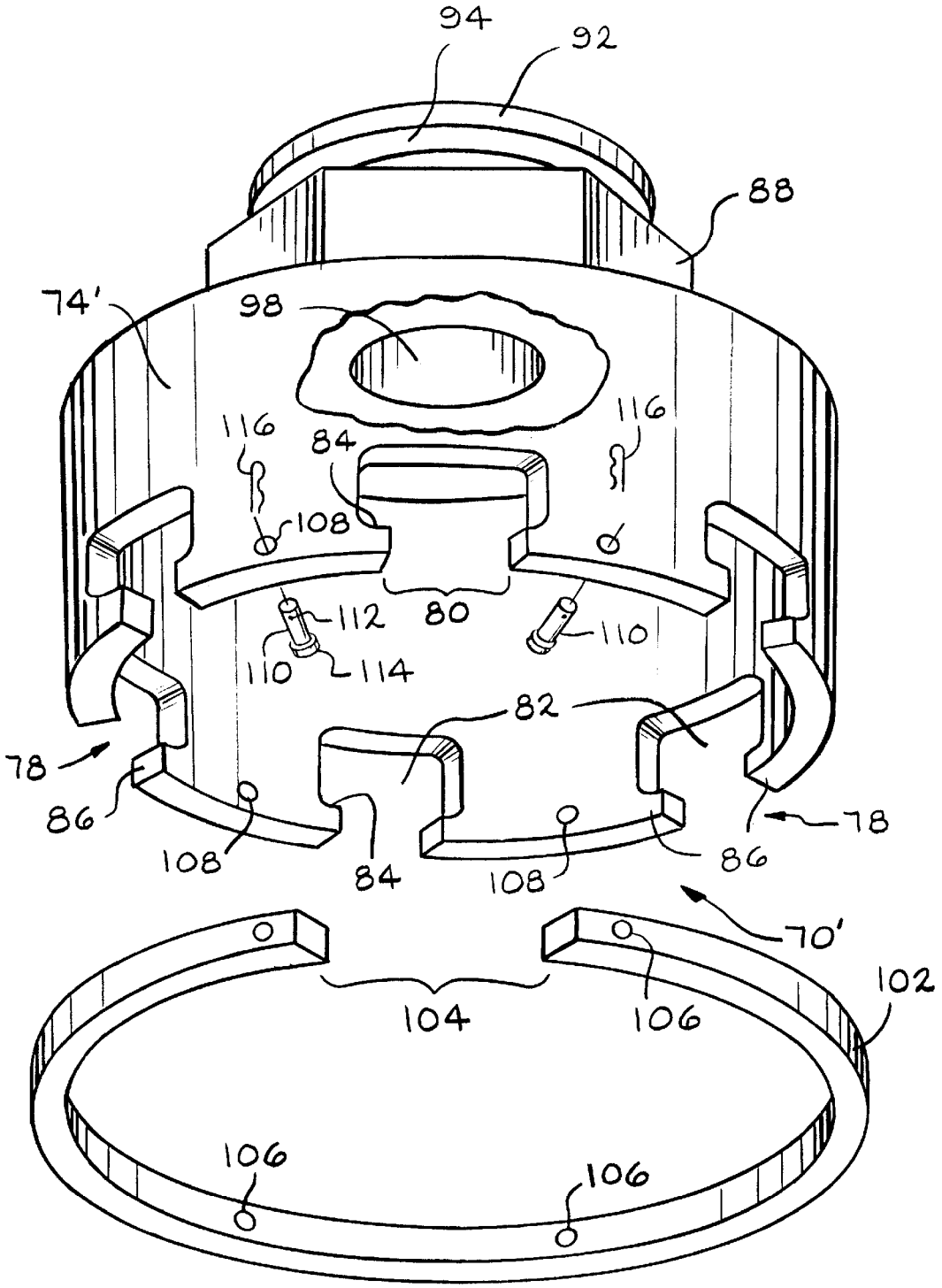
FIG. 4 is a perspective view of a castellated valve drive member having 6 slots for use with a handwheel having 2, 3 or 6 spokes.

Referring now to FIGS. 3 and 4, the power valve wrench assembly 10 also includes an annular valve drive socket assembly 70. The socket assembly 70 includes a central disk or end portion 72, a cylindrical sidewall portion 74 extending in one direction from the disk or end portion 72 and a drive stanchion 76 extending in the opposite direction from the disk or end portion 72. At a plurality of preferably equally circumferentially spaced locations in the cylindrical sidewall 74 are disposed T-shaped slots 78. The T-shaped slots 78 define a narrow, spoke receiving throat region 80 and a wider spoke retaining rectangular region 82. The axial depth of the rectangular region 82 is preferably at least equal to or slightly greater than the diameter of a typical valve spoke 26. Preferably, the rectangular region 82 is circumferentially centered on the throat region 80, that is, adjacent ledges 84 are of equal circumferential length. The ledges 84 in each slot 78 are defined by a pair of opposed teeth 86 which assist retention of the spokes 26 of the handwheel 24 within the slots 78 of the valve drive socket assembly 70. The valve drive socket assembly 70 illustrated in FIGS. 3 and 4 includes four T-shaped slots 78 equally spaced at 90 degree intervals about the cylindrical sidewall 74. Such a socket assembly 70 will function with a valve handwheel 24 having either two or four spokes 26.

The socket assembly 70 also includes a drive stub or stanchion 76 having a plurality of axially extending, preferably identical, chordal flats 88. The flats 88 are preferably six in number and disposed in opposed parallel pairs to form a hexagonal outer surface on the drive stanchion 76. However, more or fewer flats 88 may be utilized to complement, as noted above, various configurations of the polygonal opening 58 as well as other axially separable couplings such as splines or radially oriented, spring biased detents or locking pins. The drive stanchion 76 terminates in a narrow annulus 92 having a circumferential groove 94 formed in its peripheral surface. The circumferential groove 94 receives a snap ring or C-washer 96 or similar structure which selectively retains the socket assembly 70 in the intermediate drive collar 54 as illustrated in FIGS. 1 and 3. The drive stanchion 76 is hollow and defines a through, preferably circular aperture 98 which may receive the valve stem 28 as illustrated in FIG. 1.

It will be appreciated that the location of the drive stub or stanchion 76 may be exchanged with that of the polygonal opening 58 such that a similarly configured drive stub or stanchion is integrally formed with and extends (downwardly) from the intermediate drive collar 54 and a polygonal opening is disposed in the socket assembly 70.

It is anticipated that in order to make the power valve wrench assembly 10 fully adaptable to all valves 20 and specifically various patterns of spokes 26, a small number, typically two, three or four valve drive socket assemblies 70 will be available for interchangeable use with a single power valve wrench assembly 10. For example, in FIG. 4, an alternate embodiment annular valve drive socket assembly 70' is illustrated which includes six T-shaped slots 78. The six T-shaped slots 78 are in all respects identical to the T-shaped slots 78 illustrated in FIGS. 1 and 3. The six T-shaped slots 78 are arranged at equal 60 degree intervals about the cylindrical sidewall 74 of the socket assembly 70'. It will be appreciated that the valve drive socket assembly 70' is adapted for use with a handwheel 24 having either two, three or six equally spaced spokes 26. It should thus be understood that various and additional socket assemblies 70 defining, for example, five or ten T-shaped slots 78 or any other convenient or necessary number of T-shaped slots 78 required to engage particular handwheel/spoke configurations is wholly within the purview of the present invention.

Referring now to FIGS. 1, 3 and 4, the power valve wrench assembly 10 and specifically the valve drive socket assemblies 70 and 70' preferably include a safety or retaining ring assembly 100. The retaining ring assembly-100 includes a metal ring 102 which extends through an arc of approximately 300° and, in any event, at least about 270° and preferably leaves a gap 104 between its ends sufficiently large that it can be positioned about the central portion of a valve 20 and hand wheel 24 from the underside of the hand wheel 24, that is, the side adjacent the body of the valve 20. The ring 102 includes a plurality, preferably at least four, radial through apertures 106 which align with a like plurality of radial through apertures 108 formed in the side wall 74 or 74' of the socket assembly 70 or 70' respectively. When positioned as illustrated in FIG. 1 with the apertures 106 in the ring 102 and apertures 108 in the side wall 74 or 74' of the socket 70 or 70', a plurality of register or retaining pins 110 may be inserted therethrough. Each of the register pins 110 includes a radial passageway 112 on its end opposite an enlarged head portion 114. Each of the through radial apertures 112 receives a respective removable and reusable cotter pin 116 which retains the register or retaining pin 110 in the passageways 106 and 108 and thereby retains the retaining ring 102 on the drive socket 70 or 70' and, in turn, retains the valve hand wheel 24 and specifically the spokes 26 within the T-shaped slots 78.

The retaining ring assembly 100 is positioned as illustrated in FIGS. 1 and 4 after the socket assembly 70 or 70' is installed upon a valve handwheel 24 and facilitates retention of the valve handwheel 24 within the T-shaped slots 78 of the socket assembly 70 70' and reduces the likelihood of unanticipated disconnection of the valve drive socket assembly 70 or 70' from the valve handwheel 24.

Figure 2:
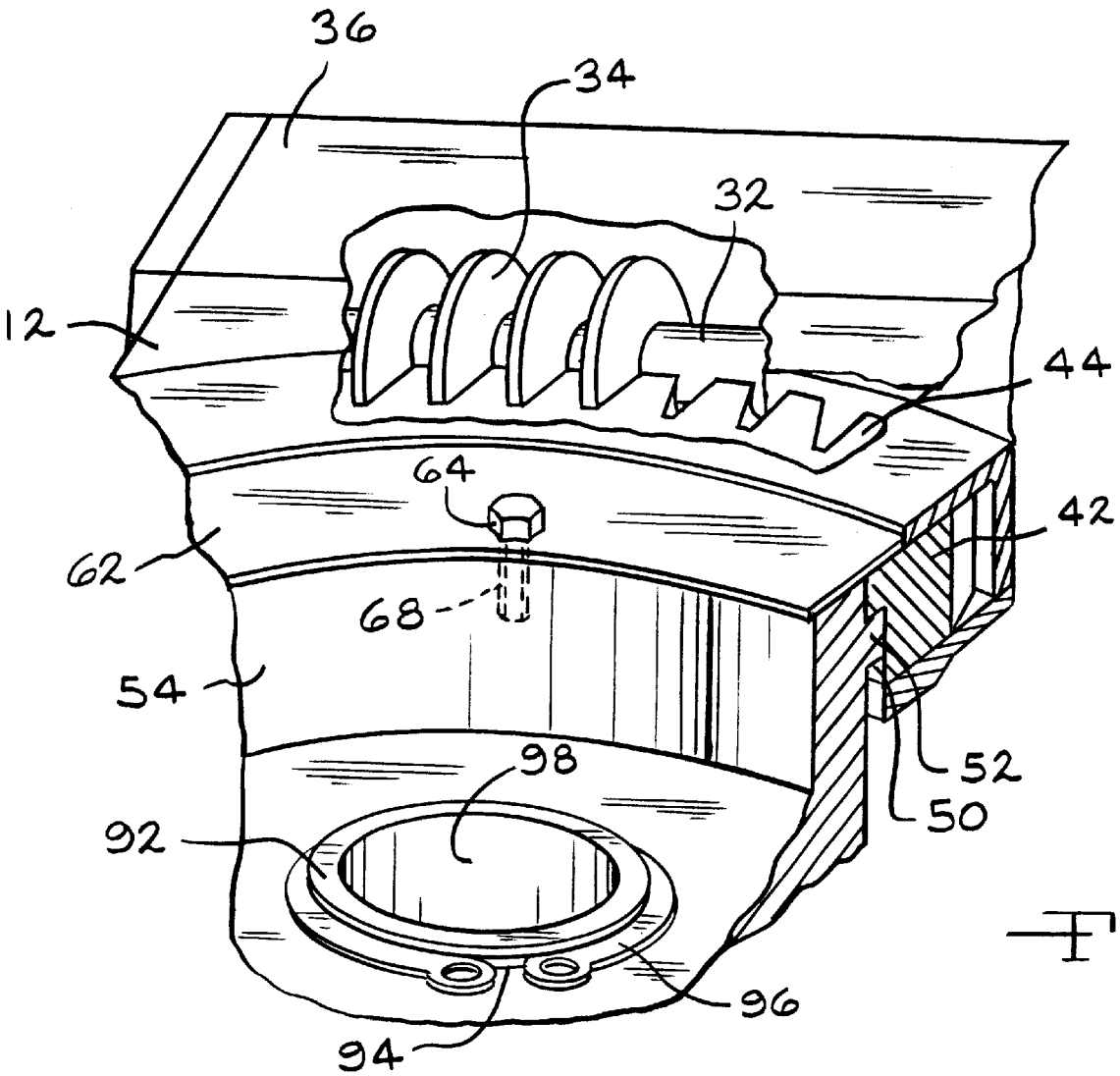
FIG. 2 is a fragmentary, perspective view with portions broken away of a gear drive mechanism of a power valve wrench assembly according to the present invention.

To utilize the power valve wrench assembly 10 of the present invention, a specific socket assembly such as the socket assembly 70 or 70' is selected which includes a pattern and number of T-shaped slots 78 which match that pattern and number of the spokes 26 of a particular valve handwheel 24 to be rotated. The selected valve drive socket assembly 70 or 70' and specifically the drive stub or stanchion 76 is then aligned with and inserted into the polygonal opening 58 of the intermediate drive collar 54. The snap ring 96 is then installed in the circumferential groove 94 to retain the valve drive socket assembly 70 or 70' in the intermediate drive collar 54 as illustrated in FIG. 2. The valve drive socket assembly 70 or 70' is then positioned on a valve handwheel 24 as illustrated in FIG. 1. Finally, the retaining ring assembly 100 is positioned as illustrated in FIGS. 1 and 4 and secured to the valve drive socket assembly 70 or 70'.

So disposed upon the valve handwheel 24, the switches in the hand grip 16 in the handle 14 are activated to rotate the handwheel 24 in the desired direction and open or close the fluid control valve 20. As noted in FIG. 1, the circular aperture 98 which extends through the drive stanchion 76 of both the valve drive socket assemblies 70 and 70' permits the valve stem 28 of the fluid control valve 20 to readily extend from the fluid control valve 20.

The foregoing disclosure is the best mode devised by the inventor for practicing this invention. It is apparent, however, that apparatus incorporating modifications and variations will be obvious to one skilled in the art of power wrenches. Inasmuch as the foregoing disclosure presents the best mode contemplated by the inventor for carrying out the invention and is intended to enable any person skilled in the pertinent art to practice this invention, it should not be construed to be limited thereby but should be construed to include such aforementioned obvious variations and be limited only by the spirit and scope of the following claims.

I claim:

1. A power wrench assembly for handwheels comprising, in combination, a drive member defining an interior adapted to receive a portion of a handwheel and sidewall having a plurality of slots adapted to receive spokes of such handwheel, a stanchion including engageable flats for receiving rotational force and an opening extending through said stanchion, a retaining ring removably attached to said sidewall and adapted to retain such spokes in said slots, and a power drive assembly having an electric motor driving a worm gear, a circular collar having gear teeth disposed thereon engageable by said worm gear and a coupling member disposed between said circular collar and said stanchion for rotatably driving said stanchion.

2. The power wrench assembly of claim 1 wherein said opening in said stanchion is adapted to receive a valve stem.

3. The power wrench assembly of claim 1 wherein each of said plurality of slots includes a narrow throat region defined by a pair of opposed projections and an enlarged region adjacent said throat.

4. The power wrench assembly of claim 1 wherein said circular collar includes one of projections and recesses and said coupling member includes the other of said projections and recesses.

5. The power wrench assembly of claim 1 wherein said circular collar includes recesses and said coupling member includes complementarily configured projections.

6. The power wrench assembly of claim 1 wherein said coupling member includes a polygonal opening complementary to said flats on said stanchion.

7. The power wrench assembly of claim 1 wherein said stanchion includes a circumferential channel adapted to receive a C-shaped retainer.

8. The power wrench assembly of claim 1 wherein said coupling member is retained within said circular collar by an annular plate.

9. A power wrench assembly for valve handwheels comprising, in combination, a drive socket defining an interior for receiving a portion of a valve handwheel and having a sidewall defining a plurality of slots adapted to receive spokes of such valve handwheel, a stanchion member for receiving rotational force and an aperture extending through said drive member, a retaining ring adapted to retain such spokes in said slots and means for releasably attaching said retaining ring to said sidewall, and a power drive assembly having an electric motor driving a worm gear, a circular collar having gear teeth engageable by said worm gear and a coupling member disposed between said circular collar and said stanchion member for rotatably driving said drive socket.

10. A power wrench assembly of claim 9 wherein said circular collar includes one of projections and recesses and said coupling member includes another of said projections and recesses.

11. A power wrench assembly of claim 9 wherein said circular collar includes recesses and said coupling member includes complementarily configured projections.

12. A power wrench assembly of claim 9 wherein said coupling member includes a polygonal opening complementary to said stanchion member of said drive socket.

13. A power wrench assembly of claim 9 wherein said means for releasably attaching includes openings in said retaining ring and adjacent said slots in said sidewall and pins adapted to be received in said openings.

14. A power wrench assembly of claim 9 wherein said coupling member is retained within said circular collar by an annular plate.

15. A power wrench assembly for handwheels comprising, in combination, a drive socket having an open face and a sidewall defining a plurality of slots adapted to receive spokes of a handwheel, a engageable member for receiving rotational force and a passageway extending through said engageable member, a retaining ring for disposition on said sidewall adjacent said slots and means for releasably attaching said ring to said sidewall, and a power drive assembly having an electric motor driving a worm gear output, a circular collar having gear teeth engageable by said worm gear and a coupling member operably disposed between said circular collar and said engageable member for engaging and driving said engageable member.

16. A power wrench assembly of claim 15 wherein said means for releasably attaching includes openings in said retaining ring and adjacent said slots in said sidewall and pins adapted to be received in said openings.

17. A power wrench assembly of claim 15 wherein said coupling member is retained within said circular collar by an annular plate.

18. A power wrench assembly of claim 15 wherein said coupling member includes a polygonal opening complementary to said drive member of said engageable socket.

19. A power wrench assembly of claim 15 wherein said engageable member includes a circumferential channel adapted to receive a C-shaped retainer.

20. A power wrench assembly of claim 15 wherein each of said plurality of slots includes a narrow throat region defined by a pair of opposed projections and an enlarged region adjacent said throat.

21. The power wrench assembly of claim 1 further including means for selectively securing said retaining ring to said sidewall.

22. The power wrench assembly of claim 21 wherein said means for selectively securing includes pins adapted to be received within complementarily sized and aligned openings in said sidewall and said retaining ring.

* * * * *